US008013801B2

(12) United States Patent
Coupez et al.

(10) Patent No.: US 8,013,801 B2
(45) Date of Patent: Sep. 6, 2011

(54) ULTRA-WIDEBAND ANTENNA WITH EXCELLENT DESIGN FLEXIBILITY

(76) Inventors: Jean-Philippe Coupez, Le Relecq Kerhuon (FR); Serge Pinel, Brest (FR); Sylvain Inisan, Plouzane (FR)

( * ) Notice: Subject to any disclaimer, the term of this patent is extended or adjusted under 35 U.S.C. 154(b) by 568 days.

(21) Appl. No.: 11/887,020

(22) PCT Filed: Mar. 24, 2006

(86) PCT No.: PCT/EP2006/061035

§ 371 (c)(1),
(2), (4) Date: Dec. 15, 2008

(87) PCT Pub. No.: WO2006/100306

PCT Pub. Date: Sep. 28, 2006

(65) Prior Publication Data

US 2009/0213025 A1 Aug. 27, 2009

(30) Foreign Application Priority Data

Mar. 24, 2005 (FR) ..... 05 02922

(51) Int. Cl.
*H01Q 9/28* (2006.01)

(52) U.S. Cl. ..... 343/807; 343/772; 343/773

(58) Field of Classification Search ..... None
See application file for complete search history.

(56) References Cited

U.S. PATENT DOCUMENTS 2,175,252 A 10/1939 Carter
2,181,870 A 12/1939 Carter
2,235,506 A 3/1941 Schelkunoff
2,239,724 A 4/1941 Lindenblad
2,454,766 A 11/1948 Brillouin
2,532,551 A 12/1950 Jarvis
2,599,896 A 6/1952 Clark et al.
3,364,491 A 1/1968 Stohr
4,630,062 A 12/1986 Dewey
4,843,403 A 6/1989 Lalezari et al.
4,947,181 A * 8/1990 Duncan et al. ..... 343/773
5,134,420 A * 7/1992 Rosen et al. ..... 343/756
5,325,105 A 6/1994 Cermignani et al.

(Continued)

FOREIGN PATENT DOCUMENTS

FR 2573576 5/1986

(Continued)

OTHER PUBLICATIONS

International Search Report, PCT/EP2006/061035.

(Continued)

*Primary Examiner* — Trinh V Dinh

(57) ABSTRACT

An ultra-wideband antenna includes a zone, an excitation means, and an adapting means. The zone is defined between first and second shaped surfaces such as to form a radiating element. The first and second shaped surfaces are also rotationally symmetrical in relation to a longitudinal axis of the antenna, and are disposed opposite one another in respect of a plane that is orthogonal to the longitudinal axis and that contains a horizontal axis. The first and second shaped surfaces are configured to control the characteristics of an electromagnetic field in the zone such that the antenna has an essentially-constant gain in the frequency band along an azimuth plane. The excitation means is configured to supply a signal in a localized manner in a central region of the zone. The adapting means is configured to promote a localized coupling between the excitation means and the zone.

40 Claims, 20 Drawing Sheets

U.S. PATENT DOCUMENTS

Figure 1:
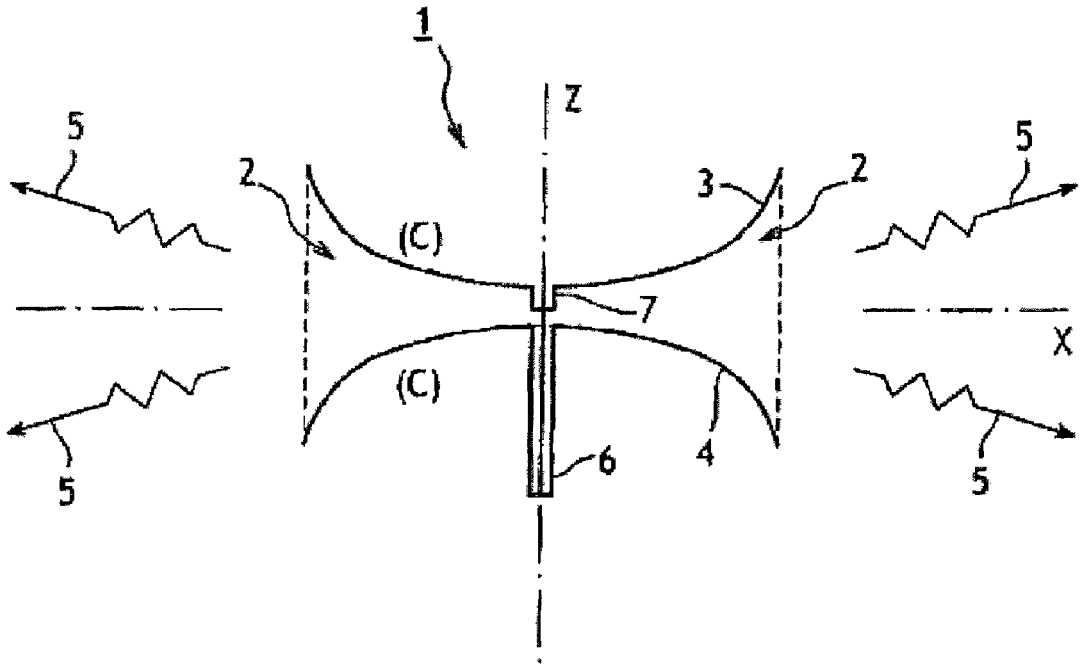

| | | | | |
|---|---|---|---|---|
| 7,479,929 | B2 * | 1/2009 | Pintos et al. | 343/772 |
| 2003/0025642 | A1 * | 2/2003 | Jocher | 343/790 |
| 2005/0093756 | A1 * | 5/2005 | Martek | 343/773 |

FOREIGN PATENT DOCUMENTS

| | | |
|---|---|---|
| FR | 2843237 | 2/2004 |
| JP | 2004-215161 | 7/2004 |
| JP | 2004-236248 | 8/2004 |
| JP | 2005-72659 | 3/2005 |
| WO | 02/056418 | 7/2002 |
| WO | 2004/038861 | 5/2004 |

OTHER PUBLICATIONS

Taylor, R. M., "A Broadband Omnidirectional Antenna," IEEE APS Int. Symp., Jun. 1994, vol. (2) 2, pp. 1294-1297.

Official Notice of Rejection for Japanese Application No. 2008-502425, mailed Jul. 21, 2010 (with English translation).

Final Decision of Rejection on Japanese Application 2008-502425, mailed Mar. 11, 2011.

* cited by examiner

FIG.3A
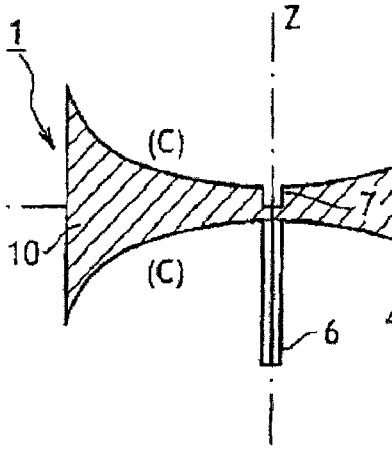
FIG.3B
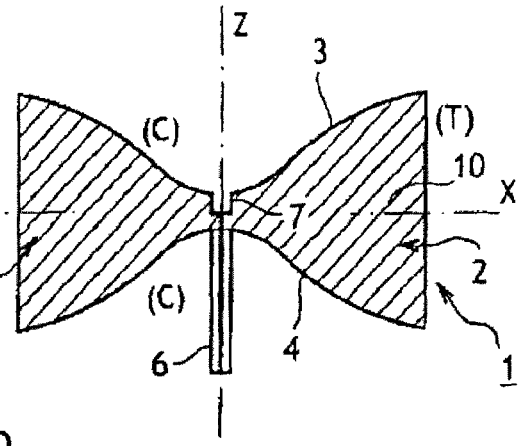
FIG.3
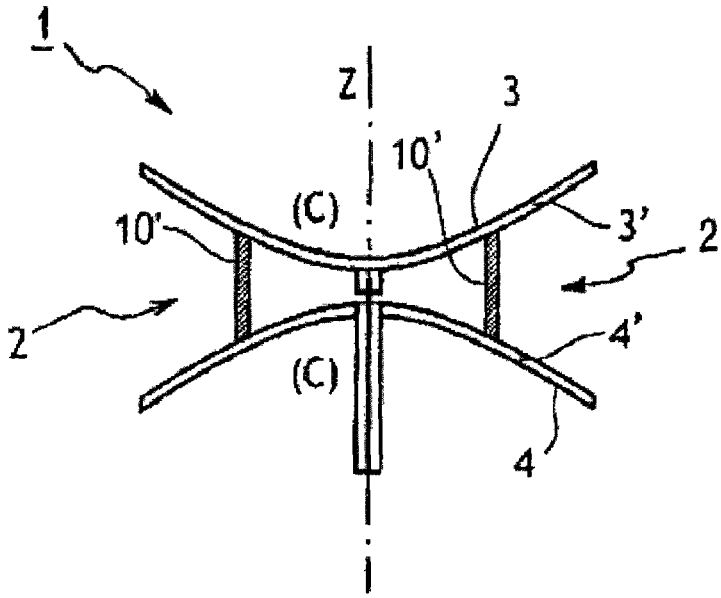
FIG.4

$(C') \neq (C)$, $H' = H$, $R' = R$ $(C') \neq (C),\ H' > H,\ R' > R$ $(C') \neq (C),\ H' > H,\ R' < R$

ULTRA-WIDEBAND ANTENNA WITH EXCELLENT DESIGN FLEXIBILITY

RELATED APPLICATIONS

This application is a 371 of PCT/EP2006/061035 filed Mar. 24, 2006, which claims priority under 35 U.S.C. 119 to an application France 0502922 filed on Mar. 24, 2005, the contents of which are incorporated herein by reference.

This present invention concerns telecommunication antennae, and in particular antennae of the ultra-wideband type (UWB).

This antenna type has long existed in the area of civil or military radars, but its attractiveness for general-purpose applications has only appeared in recent times.

By way of a non-limiting example, it is now known that such antennae open some very interesting possibilities in the area of high-speed multimedia applications, for a domestic or professional target.

There naturally exist other examples of applications for these antennae, but in any event, a known advantage of using such UWB technology, in relation to a conventional radio technology (of the narrow-band type with carrier for example), is to offer the possibility of very high transmission speeds.

Another known advantage of the UWB technology is that it is very robust in relation to problems of interference and fading of the signal in the case of multiple-path propagation.

Another known advantage of this UWB technology is that it has an extremely wide frequency spectrum.

As an example, a recent regulation of the FCC (Federal Communications Commission) allows the use of a frequency band of between 3.1 GHz and 10.6 GHz without a license.

As a fundamental component of such a communication system, many implementations of UWB antennae have already been proposed.

One is already familiar, for example, with a first large family of UWB antennae which are antennae of the dipole type (such as of the biconical, planar type with a square or triangular geometry) and of the single pole type (such as antennae of the single-pole, conical type, for example) [1-6].

It will be noted in this case, that in the case of antennae of the dipole type, solutions with radiating elements symmetrical or asymmetrical shape [4] have been proposed.

Although the antennae of this first family can provide good performance, one problem is that their dimensions are dependent on the working frequency of the antenna.

More precisely, the dimension of the radiating elements in particular is imposed by the lowest working frequency used in the application concerned.

Thus in the case of an antenna of the biconical dipole type, the dimension of each of the cones is equal to $\lambda/4$, where $\lambda$ is the longest working wavelength in the application concerned.

As a consequence, knowing the working frequencies of the said application, a designer of such an antenna has very little room for manoeuvre in its implementation.

And the consequence can be that the antenna does not comply with a precise specification, in terms of compactness in particular.

One is also familiar with a second large family of UWB antennae.

This includes antennae of the horn configuration type [7-10].

We know in particular of antennae with radiating elements of the coaxial horn or transverse electromagnetic (TEM) horn type, for example.

Other variants in this second family of antennae are again based upon the use of radiating elements with shaped profiles, most often according to exponential laws, and excitation or feed systems based on baluns or cavities [9-10].

In the case of antennae in this family, the designer is able to manipulate a greater number of degrees of freedom than previously.

In particular, the constraint on the dimensions of the radiating elements as a function of the working frequencies is eased, offering the possibility of using radiating elements of smaller dimensions than that of the first family of antennae for example.

In spite of this, the design flexibility of the antennae in this second large family still remains incapable of satisfying very varied specification schedules, while also achieving a compact result.

As an example, in order to improve the performance of the antenna, in particular when its dimensions are small, use is made of a gradual matching element that allows one to achieve a coupling with a gentle transition between a feeder element and the radiating elements.

Now however, as a result of its principles of operation, it is this gradual matching element which occupies a significant space and which results inevitably in an antenna that is not compact.

Finally, a third large family of antennae is that of the shaped slot antennae.

One is familiar in particular with an antenna that includes radiating elements in a double-slot planar configuration [11].

Another antenna of this third large family has radiating elements in a configuration with two planar double slots positioned perpendicularly [12].

A drawback of these antennae is that they cannot be used to achieve a homogeneous radiation pattern in the azimuthal plane.

Moreover, if matching elements have also been proposed with these antennae, their dimensions are unfortunately imposed by the lowest working frequency in the specification.

In particular, the dimension must be equal to $\lambda/4$, which here again limits the compactness of the antenna.

Document FR 2 843 237 describes an antenna of the single pole type from the aforementioned first large family.

It can be seen however that the radiation pattern of this antenna varies as a function of the frequency, in particular in the azimuthal plane (OXY).

Furthermore, in particular, this antenna has the drawback of controlling the electromagnetic field only by means of a surface shaped like a chalice 1.

Furthermore, this antenna does not generate a signal in its central region in a localised manner, and does not have any matching element to favour localised coupling between the feeder means 4 and the said region.

Documents U.S. Pat. No. 2,532,551 and FR 2 573 576 concern an ultra-wideband antenna belonging to the aforementioned second large family. In fact this is a biconical horn antenna.

These have the previously mentioned drawbacks of this type of antenna, due in particular to an absence of localised coupling of the signal in the central region.

Document WO 02/056418 concerns a wideband electromagnetic probe.

Like document FR 2 843237, this antenna is not of the ultra-wideband type, and does not lend itself to such use either.

In particular, it has a single surface 100 to control the electromagnetic field, with this surface 250 being connected to a mass.

Moreover, it does not have any efficient and compact matching element to favour localised coupling between the coaxial drive 302 and the zone 400.

One aim of the invention is therefore to propose an improved antenna.

In particular, the invention has as its objective to propose a UWB antenna with omnidirectional radiation in the azimuthal plane and with the most constant possible value of gain with frequency in this plane.

Moreover, the antenna according to the invention advantageously has a simple geometry and provides great design flexibility in order to comply with very different specifications.

Furthermore, in particular by virtue of this great simplicity of implementation, it can also satisfy many other constraints, in particular such as high technological reproducibility, low cost and small size. The invention thus proposes an ultra-wideband antenna that is characterised in that it includes:

- a zone formed between first and second shaped surfaces to create a radiating element, where these surfaces also display a symmetry of revolution about a longitudinal axis of the antenna, being positioned opposite to each other in relation to a plane that is orthogonal to the longitudinal axis and that contains the horizontal axis, and with a profile and dimensions that are designed to control the characteristics of an electromagnetic field in the zone, so that the antenna has a gain that is more-or-less constant over the frequency band, in the azimuthal plane,
- a feeder means extending parallel to the longitudinal axis and capable of supplying the signal in a localised manner in the central region,
- a matching means, associated with the first shaped surface, surface-mounted in the central region of the zone and in the direction of the second shaped surface, with the matching means being capable of favouring localised coupling between the feeder means and the said zone.

Preferred and non-limiting aspects of this antenna are as follows:

- the zone is entirely filled with air;
- the zone consists of a single block of material that has symmetry of revolution in relation to the longitudinal axis;
- the zone is entirely filled with the single block of material;
- the two shaped surfaces are respectively formed by two separate elements;
- the single block of material is arranged to support the two separate elements;
- in the said zone, the antenna also includes spacers and/or rods whose extremities are attached to the two separate elements;
- the two shaped surfaces respectively correspond to first and second opposite surfaces of the single block of material, so that these two shaped surfaces and this single block of material form only a single part;
- the single block of material also has an external section in contact with the air and constituting one external side of the antenna;
- the single block of material also has an internal section at least partially containing the central region of the zone;
- the central region enclosed at least partially by the internal section includes air;
- the section or sections of the single block of material have a profile that is used to control the characteristics of the electromagnetic field in the zone;
- in longitudinal section, at least one portion of the profile of the section or sections of the single block of material has a shape selected from the following:
  - a. rectilinear,
  - b. concave in relation to the longitudinal axis,
  - c. convex in relation to the longitudinal axis;
- in longitudinal section, at least one portion of a profile of each of the two shaped surfaces has a shape selected from the following:
  - a. rectilinear,
  - b. concave in relation to the plane orthogonal to the longitudinal axis and that contains the horizontal axis,
  - c. convex in relation to the plane orthogonal to the longitudinal axis and that contains the horizontal axis;
- the profile of at least one of the two shaped surfaces includes at least one inflection point;
- more-or-less at its centre, the second shaped surface includes an orifice, with the said orifice including at least part of the feeder means;
- one extremity of the feeder means is in contact with the matching means;
- the feeder means is a coaxial line with a central core, one end of which is in contact with the matching means;
- the single block of material is a dielectric material of a type selected from the following list: foam, plastic or ceramic;
- the section or sections include conducting patterns;
- the antenna has a symmetry of revolution about the longitudinal axis;
- the antenna is arranged to accept an electronic circuit not far from it, and to protect it from the electromagnetic field that it is radiating;
- the electronic circuit is placed as close as possible to the antenna;
- the second shaped surface forms a recess on the outside of the antenna and the electronic circuit is incorporated into this recess;
- the matching means and the single block of material form a single part;
- the matching means is a stub;
- the two shaped surfaces are metal-coated.

In addition, the invention also proposes a telecommunication system that is characterised in that it includes an ultra-wideband antenna that is designed with the aforementioned characteristics, either singly or in combination.

Thus, the appropriate combination of the various means presented above enables one to offer many degrees of freedom to a UWB antenna designer and to implement the latter in a simple manner so as to provide the advantages of the invention, in particular the ability to satisfy a varied specification schedule while still remaining compact.

Figure 2:
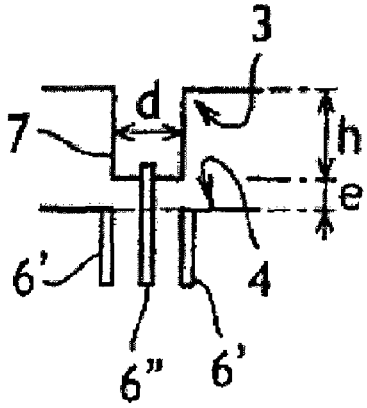
Figure 5:
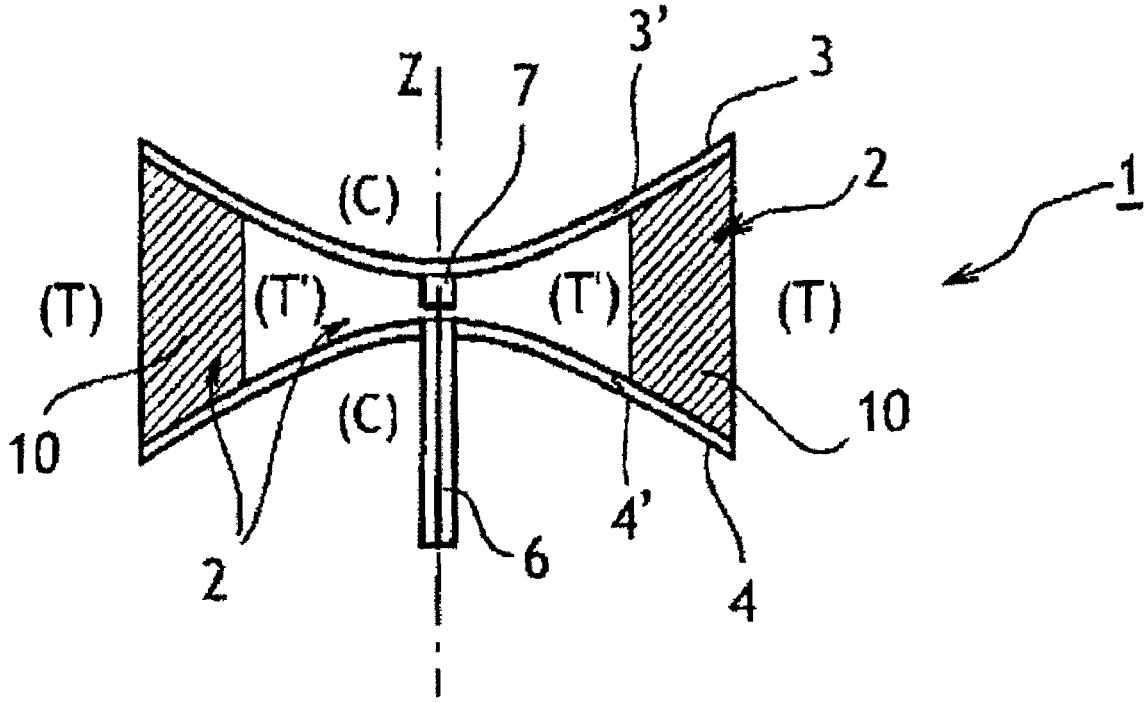
Figure 6:
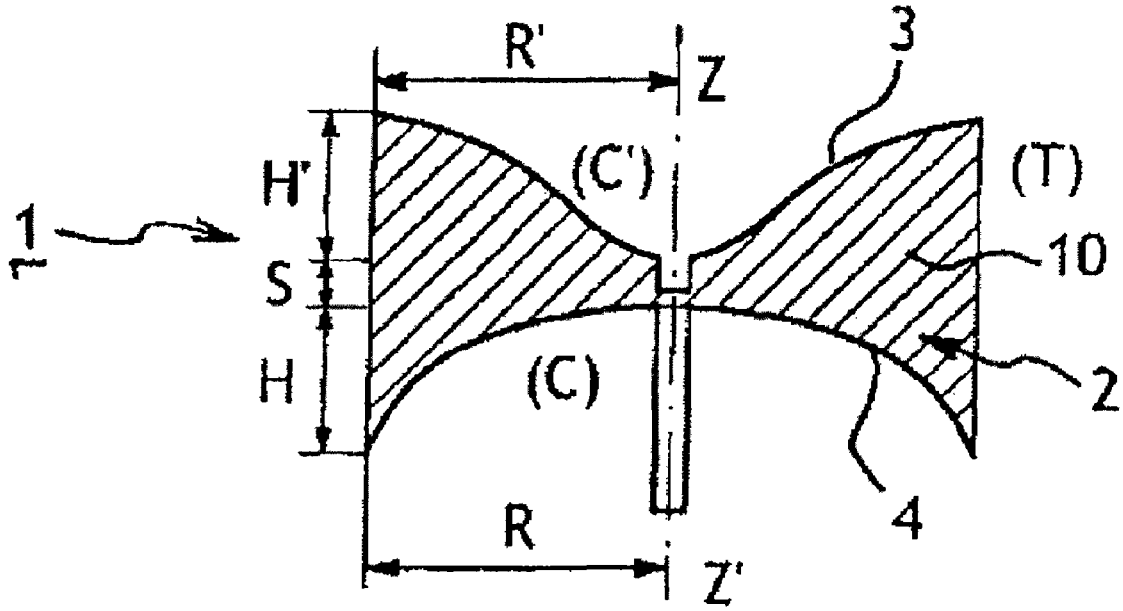
Figure 7:
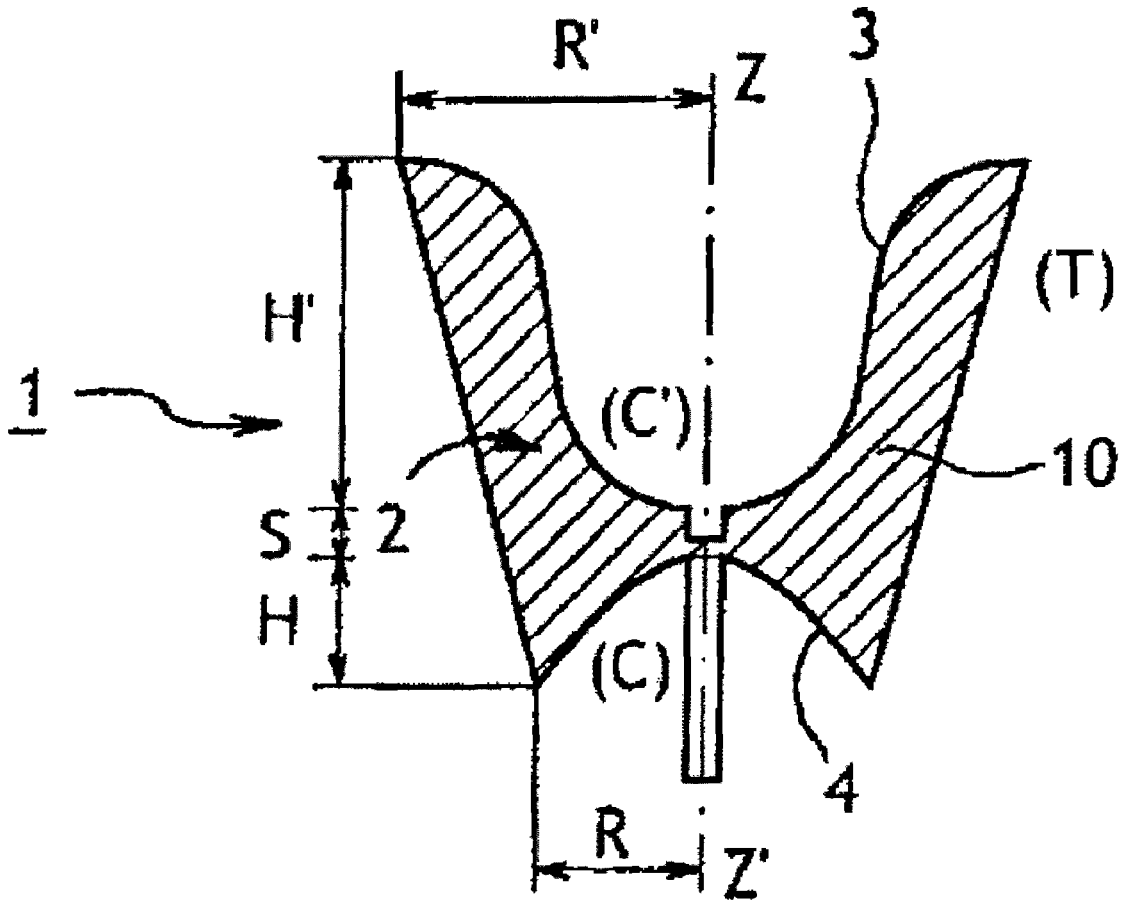
Figure 8:
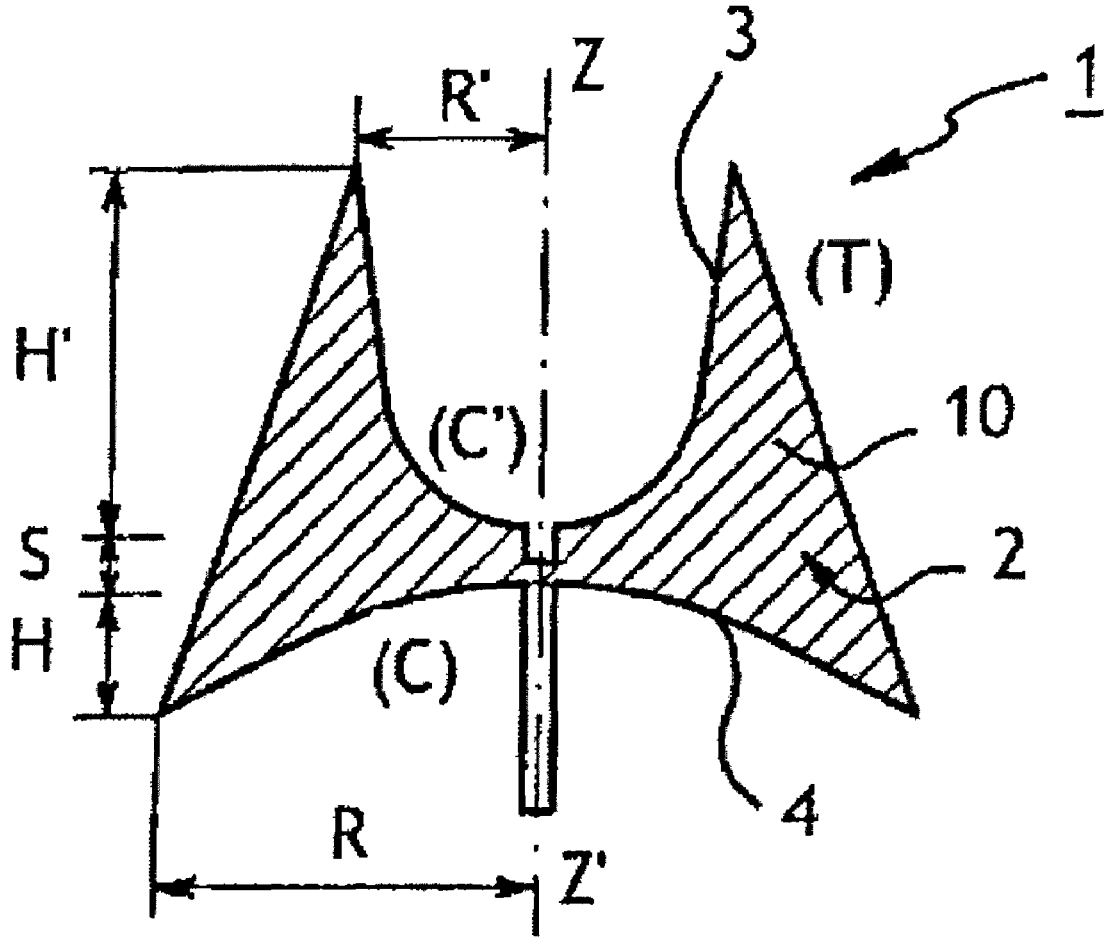
Figure 9:
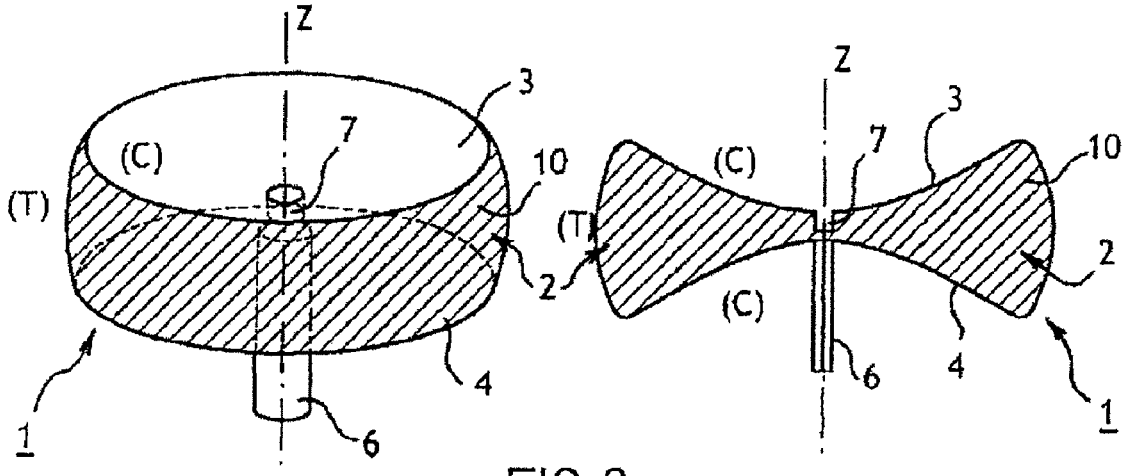
Figure 10:
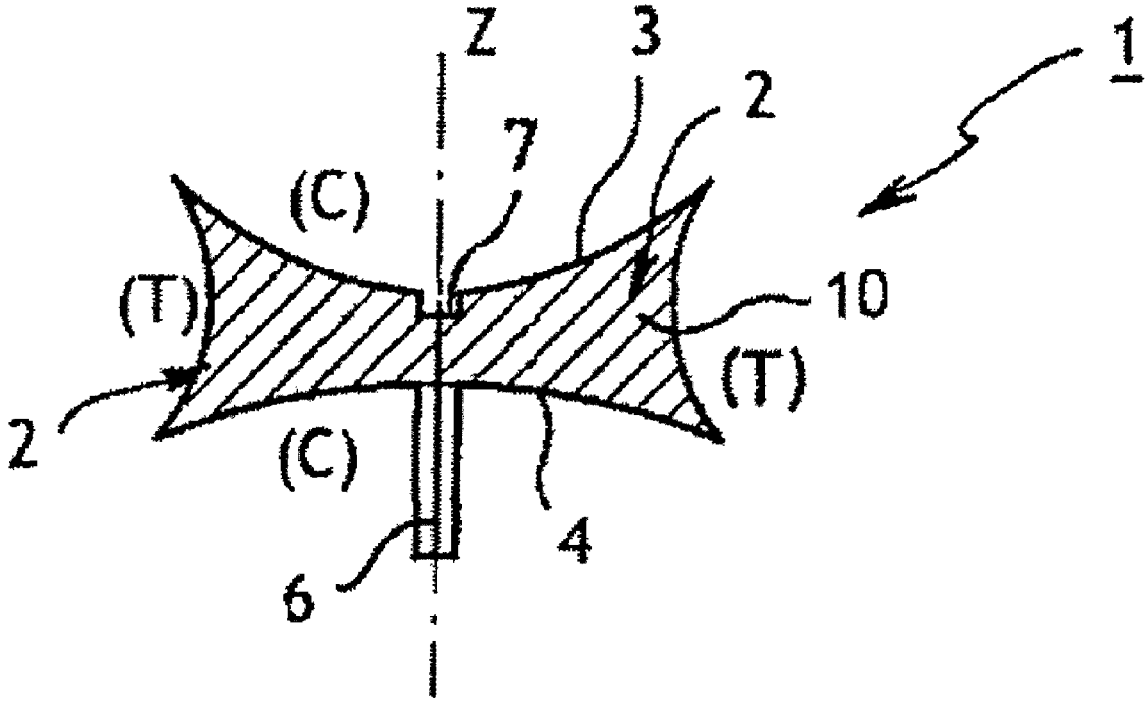
Figure 11:
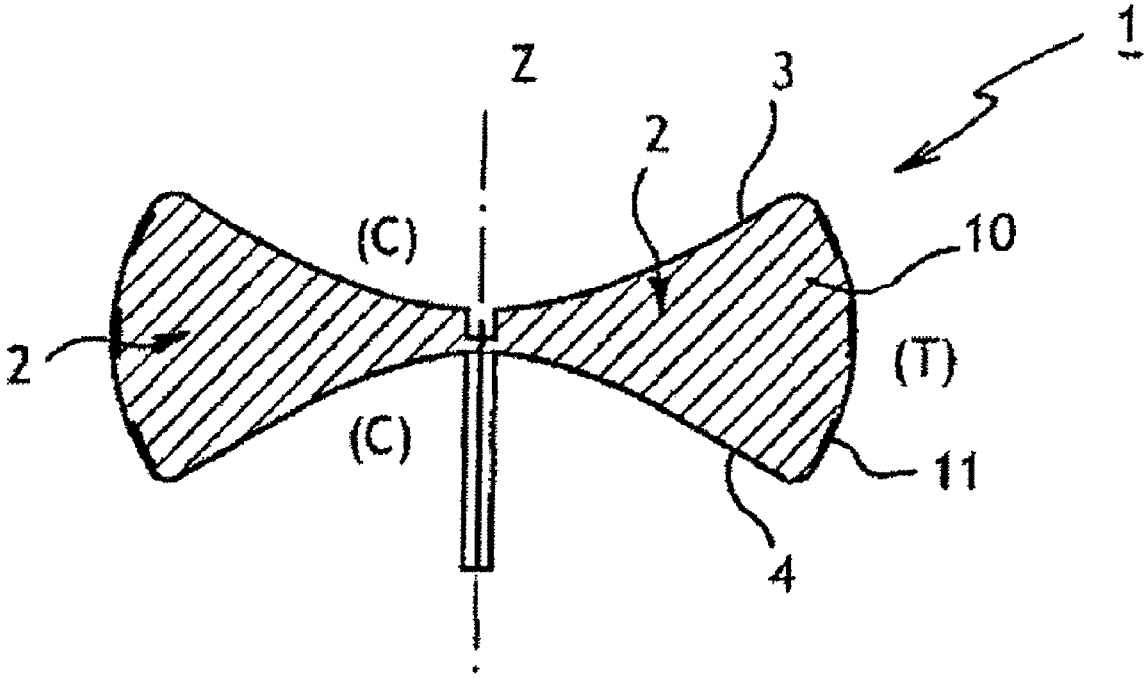
Figure 12:
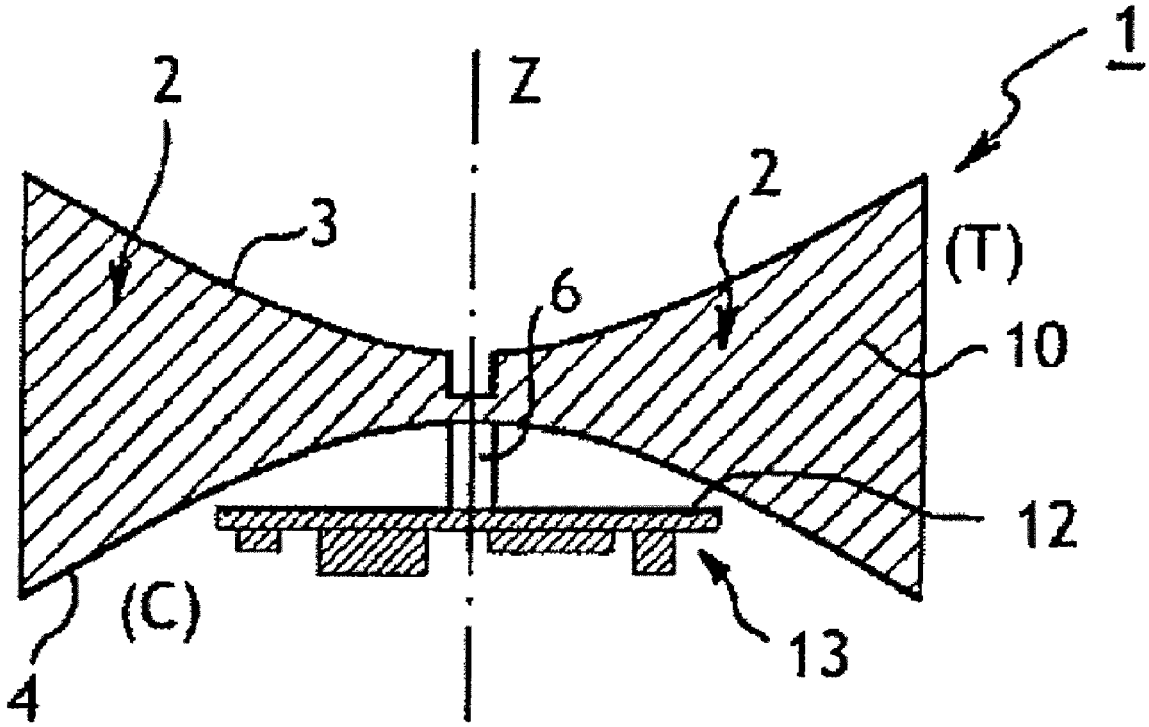
Figure 13:
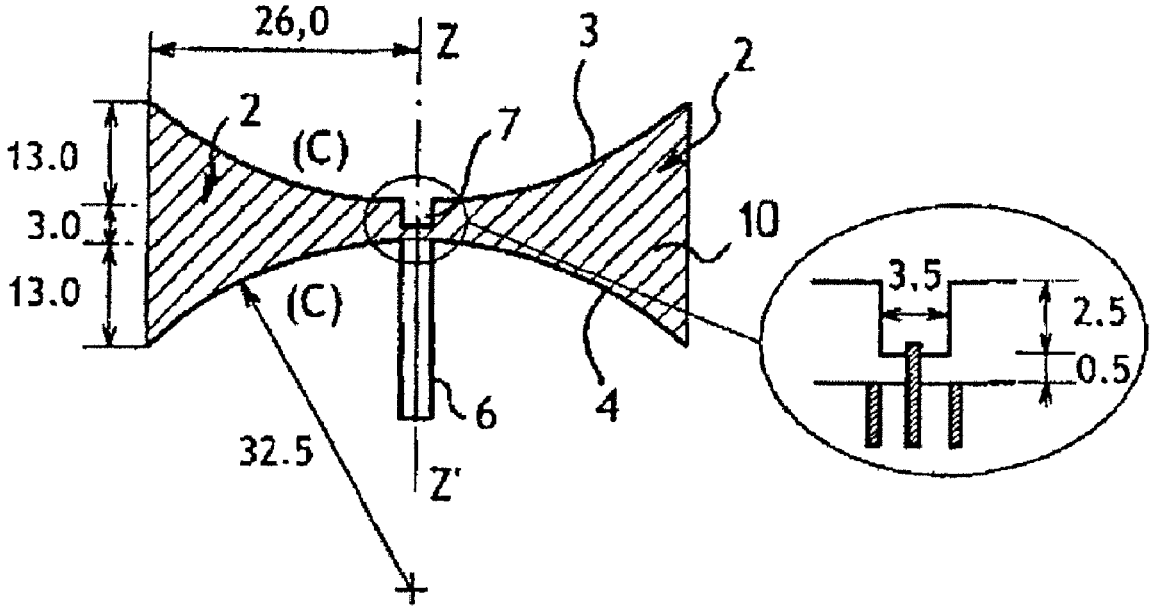
Figure 14:
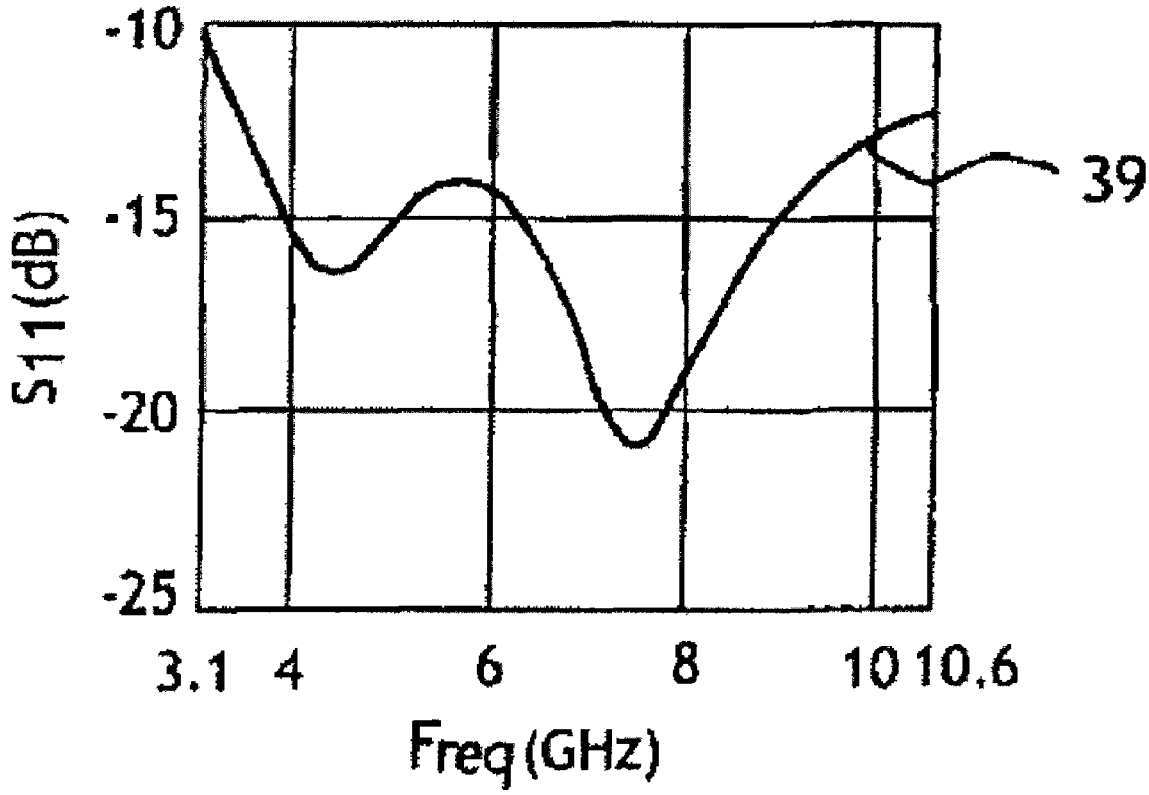
Figure 15:
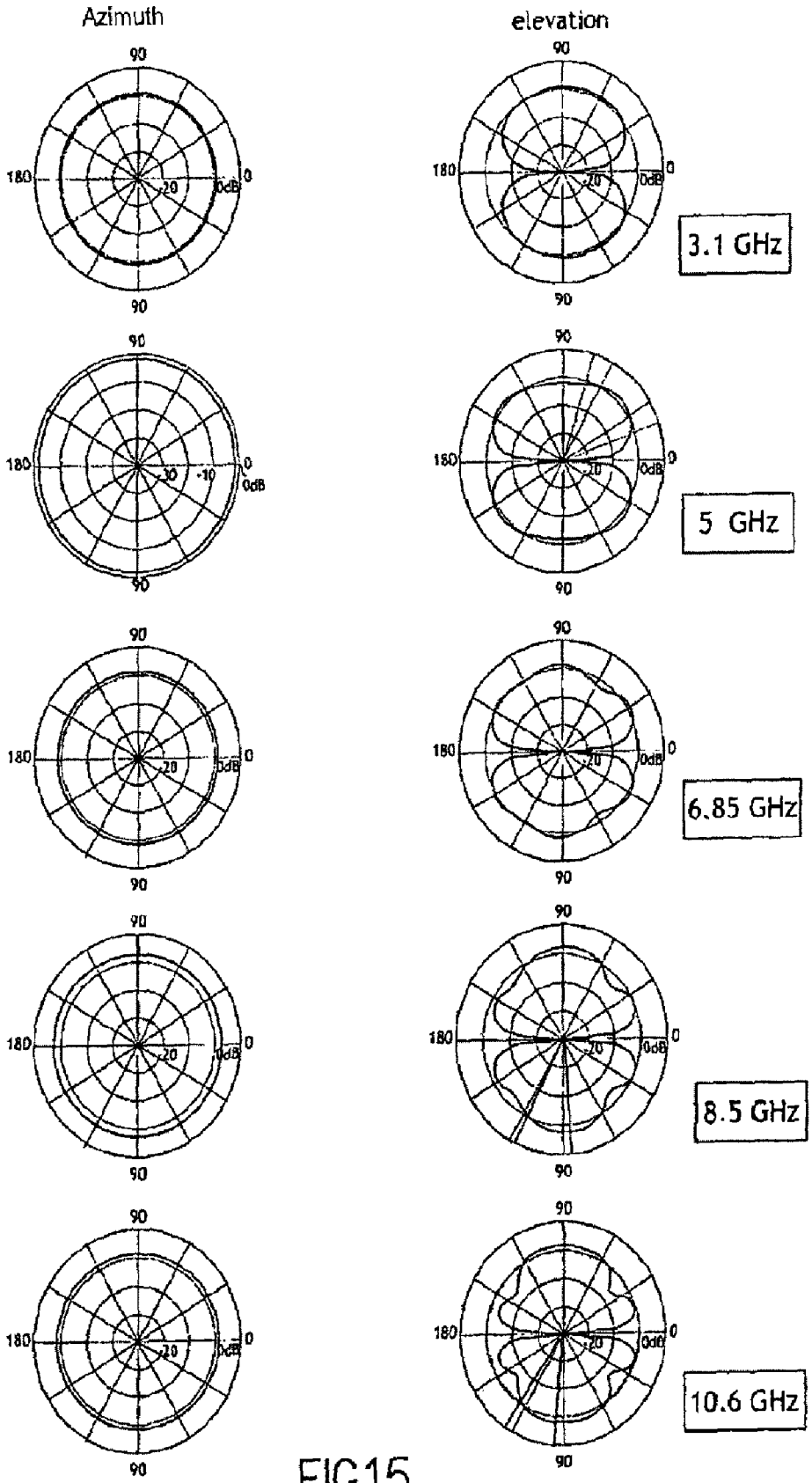
Figure 16:
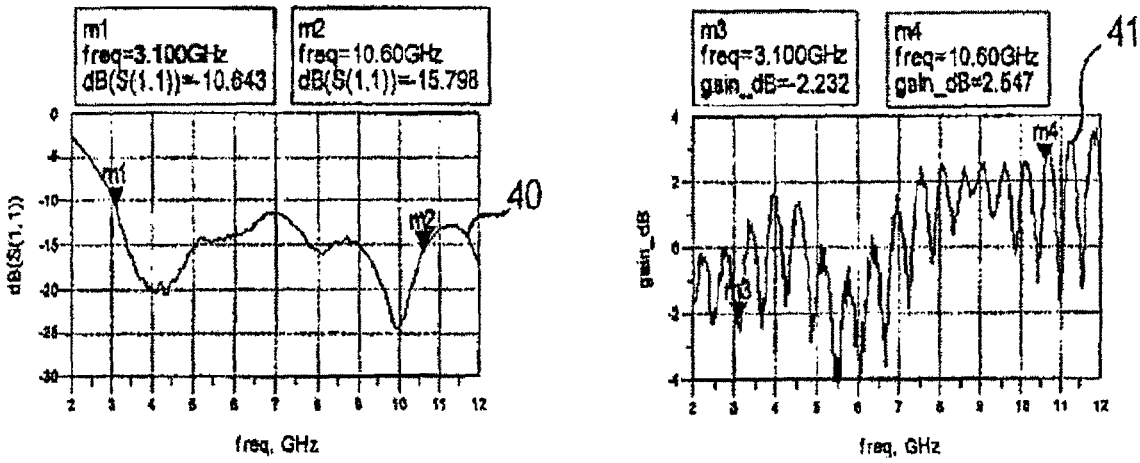
Figure 17:
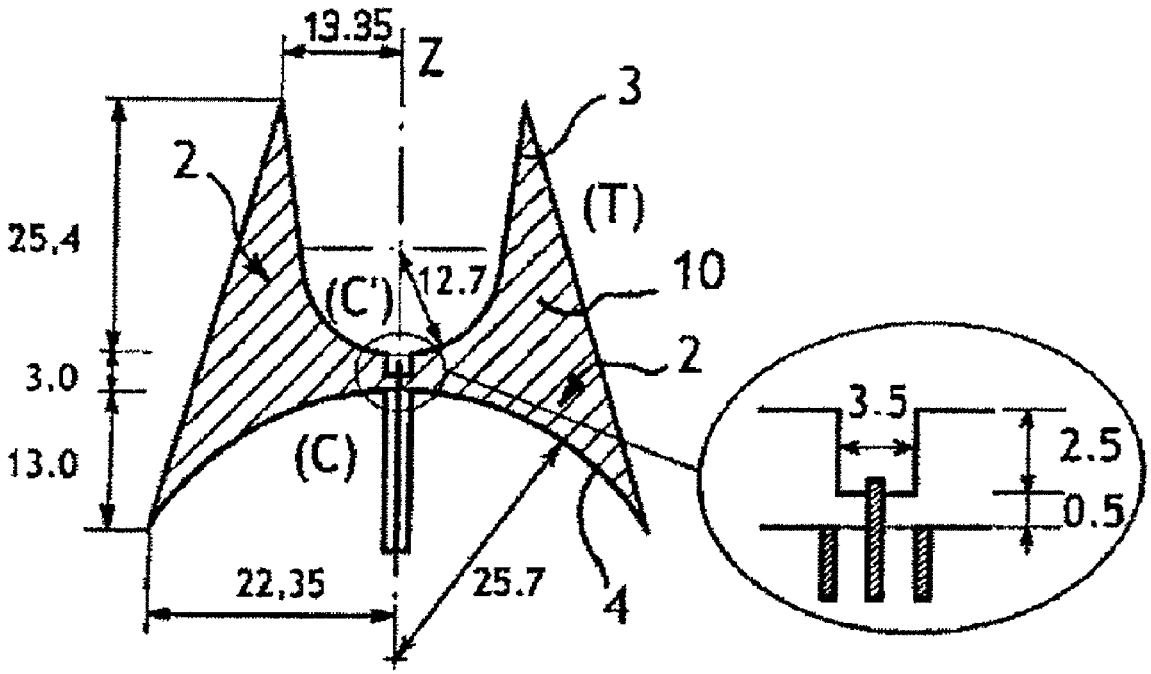
Figure 18:
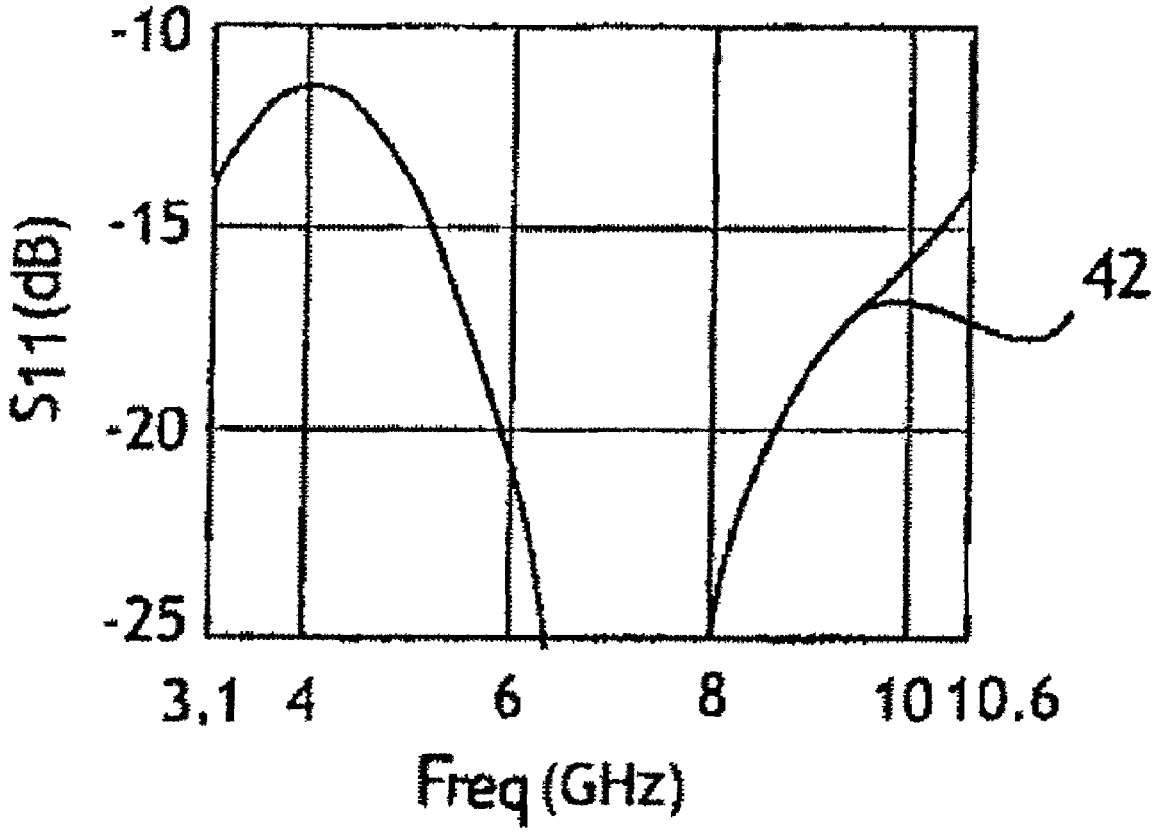
Figure 19:
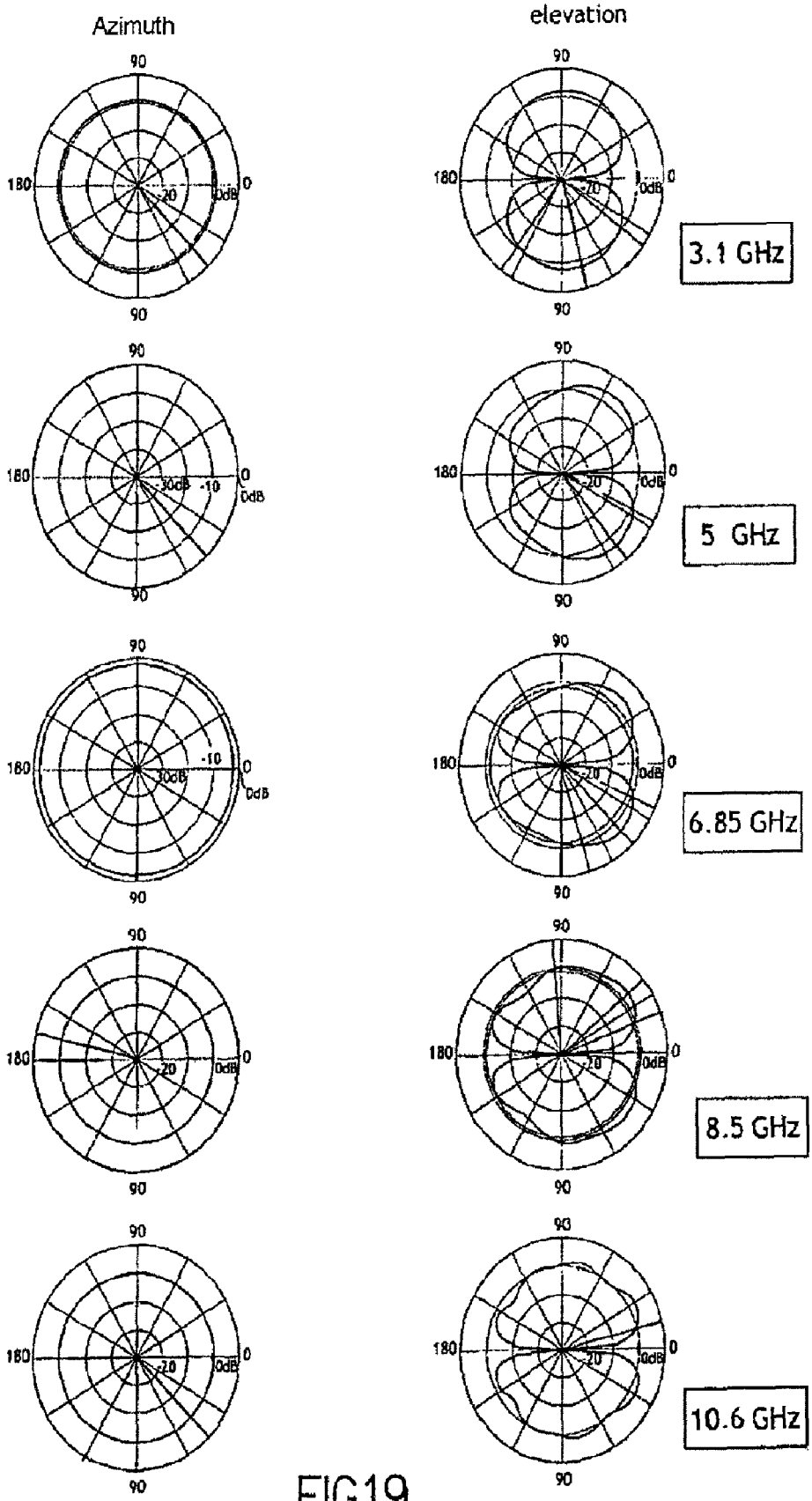
Figure 20:
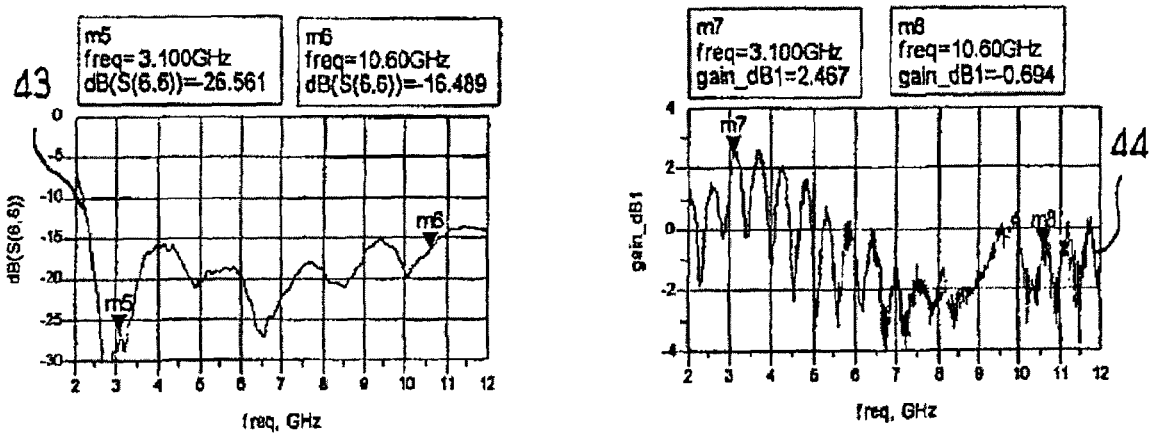

Other aspects, aims and advantages of the invention will appear more clearly on reading the description that follows of the invention, with reference to the appended drawings, in which:

FIG. 1 is a view in section, on a plane that contains the longitudinal axis (Z), of an antenna according to the invention which has two shaped surfaces positioned symmetrically in relation to a plane that is perpendicular to the longitudinal axis (Z) and that contains the horizontal axis (X), FIG. 2 is a magnified view in longitudinal section of the central region of the zone, in which the feeder and matching elements are located, FIG. 3 is a view in longitudinal section of two antennae according to the invention, each of which has two shaped surfaces whose profile is substantially different from that of the antenna shown in FIG. 1, FIG. 4 is an antenna according to the invention, in which the zone is entirely filled with air, FIG. 5 is an antenna according to the invention that includes, in the zone, a single block of material that has two sections (T and T'), FIG. 6 is a view in longitudinal section of an antenna according to the invention which has two shaped surfaces whose profile is different and whose section (T) has a profile parallel to the longitudinal axis (Z), FIG. 7 is a view in longitudinal section of an antenna according to the invention which has two shaped surfaces whose profile is different and whose section (T) has a rectilinear profile that is inclined in relation to the longitudinal axis, FIG. 8 is a variant of the antenna of FIG. 7, in which further use is made of the profile of the facing surfaces, and of the section (T), FIG. 9 shows, in longitudinal section, an antenna according to the invention in which the section (T) of the single block of material has a profile that is curved toward the exterior of the antenna, FIG. 10 shows, in longitudinal section, an antenna according to the invention in which the section (T) of the single block of material has a profile that is curved toward the interior of the antenna, FIG. 11 is an antenna according to the invention whose section (T) includes conducting patterns on its surface, FIG. 12 illustrates the incorporation of an electronic circuit into an external recess in an antenna according to the invention, FIG. 13 is a detailed example of the implementation of an antenna according to the invention, FIG. 14 shows a simulation of the matching as a function of the frequency band chosen for the antenna taken as an example in FIG. 13, FIG. 15 shows simulations of radiation patterns, in azimuth and in elevation, of the antenna of FIG. 13, for different frequencies in the said frequency band, FIG. 16 shows matching and gain measurements for the antenna of FIG. 13 in the azimuthal plane, FIG. 17 is a second detailed example of implementation of an antenna according to the invention, FIG. 18 shows a simulation of the matching as a function of the frequency band chosen for the antenna taken as an example in FIG. 17, FIG. 19 shows simulations of radiation patterns, in azimuth and in elevation, of the antenna of FIG. 17, for different frequencies in the said frequency band, FIG. 20 shows matching and gain measurements for the antenna of FIG. 17 in the azimuthal plane.

Figure 21:
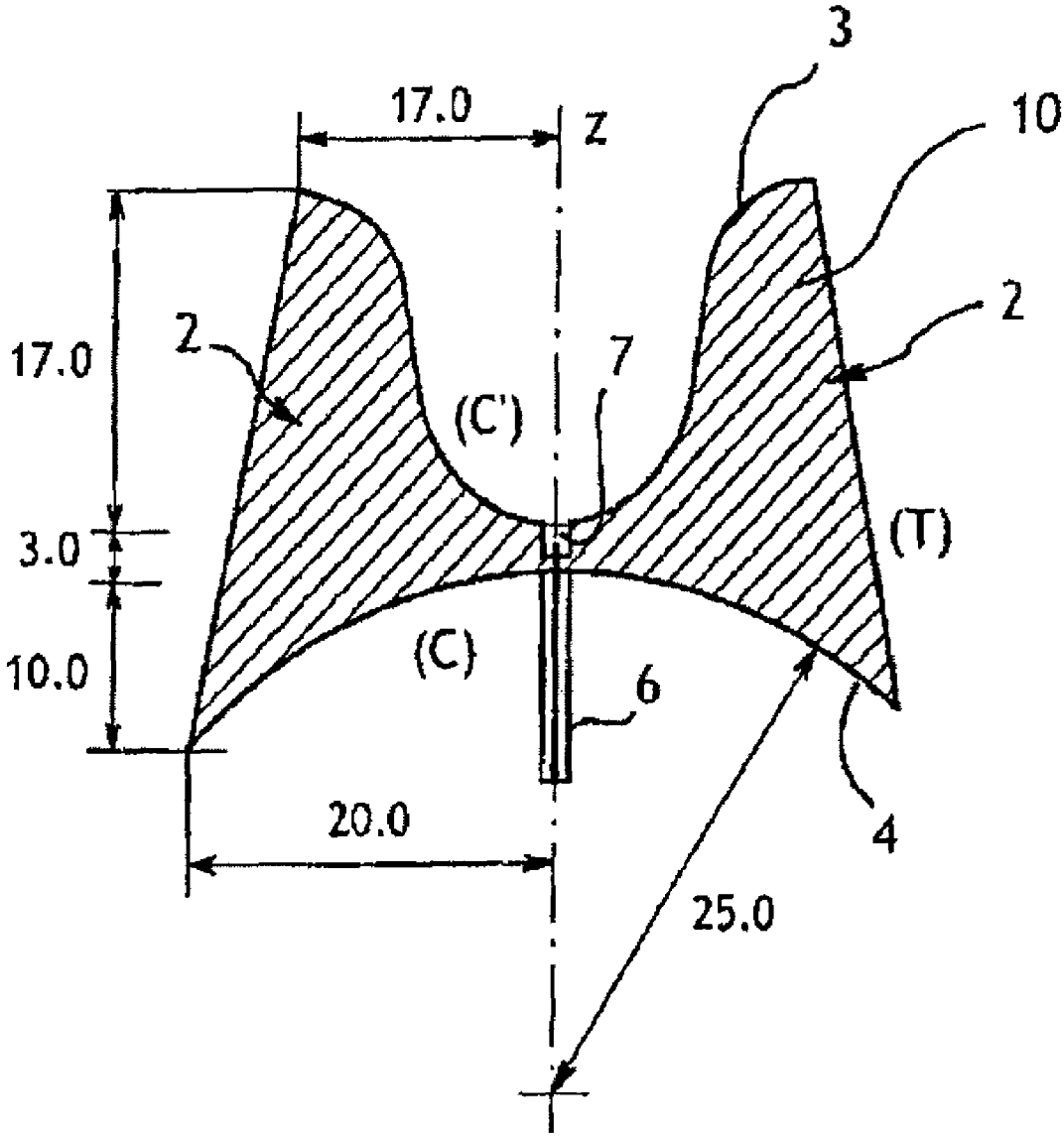
Figure 22:
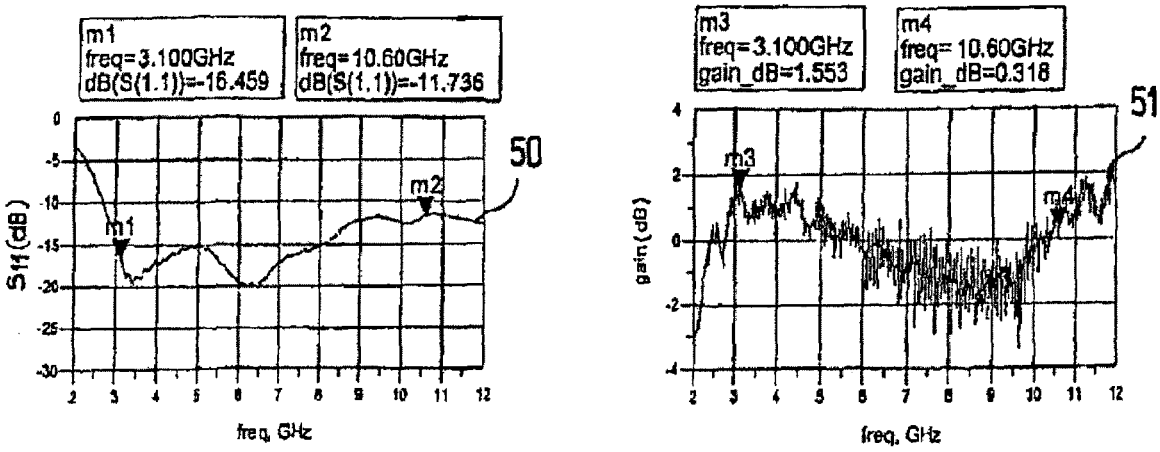

FIG. 21 is a third detailed example of implementation of an antenna according to the invention, FIG. 22 shows matching and gain measurements for the antenna of FIG. 21 in the azimuthal plane.

It will be noted right away that, in the following text, the term distal is meant in relation to the centre of the antenna.

Furthermore, in order to simplify reading, it is assumed that the longitudinal axis (Z) is aligned with a vertical axis, and therefore that the axis (X) represented in the figure is aligned with a horizontal axis.

Regarding FIG. 1, we have shown in section, on a plane that contains the longitudinal axis (Z), an ultra-wideband antenna 1 according to one embodiment of the invention.

This antenna 1 includes two identical shaped surfaces 3, 4 placed opposite to each other in relation to a plane that is perpendicular to the longitudinal axis (Z) and that contains the horizontal axis (X).

A zone 2 is formed between these two shaped surfaces.

Zone 2 therefore generally displays an outline that is perfectly delimited by the two facing shaped surfaces 3, 4.

In this embodiment, the latter have a profile (C) in the form of a parabola that is open upwards and downwards respectively.

However, whatever the profile that is chosen, it is always arranged that its shape is such that an electromagnetic field existing in zone 2 has characteristics that allow a signal 5 supplied at the central region of this zone to propagate in an azimuthal direction, with a gain that is as constant as possible with frequency.

In other words, it is always arranged that the profiles and dimensions of these two surfaces 3, 4 are designed to control the electromagnetic field in zone 2 so that the antenna generally presents a gain that is as constant as possible over the selected frequency band, according to the direction or the azimuthal plane.

It will be noted that, according to the invention, by a gain that is as constant as possible is meant a gain whose variation remains below 1.5 dB over a passband that is at least greater than fmax/fmin=5.

As a consequence, according to the invention, the profile (C) of the shaped surfaces represents a degree of freedom (a parameter) in the design of the antenna.

This aspect will be described later in greater detail.

Returning to FIG. 1, the horizontal axis (X) corresponds to an axis of symmetry for these two surfaces 3, 4 and therefore for zone 2.

Again more generally, the antenna, or at least the two shaped surfaces, possess a symmetry of revolution about the vertical axis (Z), which contributes in particular to achieving a high degree of uniformity in the radiation pattern of the antenna in the azimuthal plane.

The latter also includes a feeder means 6, typically a coaxial line, extending parallel to the vertical axis (Z) and capable of supplying a signal 5 to a central region of zone 2.

A part of this feeder means is incorporated into a vertical through orifice created more-or-less at the centre of the shaped surface 4.

In this way, the feeder means 6 can reach the central region of zone 2 from the exterior at the bottom of the antenna.

And as shown in particular in FIG. 1, the feeder means is thus capable of supplying the signal 5 in a localised manner at the central region.

Again more precisely, the feeder means 6 also traverses the central region of zone 2 to come into intimate contact with a local matching means 7 placed at the centre, under the shaped surface 3.

As a consequence, the matching means 7 is located more-or-less facing the through orifice.

As illustrated in FIG. 1, the matching means 7 comes in the form of a cylindrical stub projecting from the surface 3 in the direction of the through orifice.

Such a matching means is used to locally favour a transition of the signal between the feeder means 6 and zone 2 while still remaining of small dimension.

FIG. 2 shows a detailed view in longitudinal section of the central region of zone 2.

It will simply be observed for the remainder of the description, that the stub 7 has a diameter and a height, respectively noted d and h.

It will also be remembered that there exists a configurable space, of length e, along the vertical axis between the bottom end of the stub 7 and the top end of the through orifice.

As mentioned previously, the feeder means, shown here by way of a non-limiting example, is a coaxial line 6 that includes a central core 6" connected to the bottom end of the stub 7 and a peripheral conductor (screen) 6' surrounding the central core 6" and connected electrically to the shaped surface 4.

In this regard, it should be noted that the shaped surfaces 3, 4 are covered with a thin coat of conducting material and together form a radiating element.

Zone 2 will now be described in greater detail.

In this regard, FIG. 3 illustrates a preferred variant of the invention.

Here we have presented two antennae, whose zone 2 is entirely filled with a single block of material 10.

This single block 10 therefore lies about the vertical axis (Z) and from the central region up to the extremity of the antenna determined by the distal edge of the shaped surfaces 3, 4.

The surface of the single block 10 that is located in contact with the air in one side of the antenna constitutes a section (T) whose profile can serve as a degree of freedom (a parameter) in the design of the antenna.

It will also be observed in this variant, that the two shaped surfaces 3, 4 are respectively the upper and lower surfaces of the single block of material 10 so that there exists only a single physical part.

Thus, the essential of the volume of zone 2 is to some extent determined by the volume of the single block of material 10 itself.

It will also be noted that the matching means 7 and the single block of material 10 also constitute a single part.

In another variant, the two shaped surfaces 3, 4 are formed respectively by two separate elements 3', 4'), that is by two independent physical parts.

Zone 2 can then be entirely filled with air, as illustrated in FIG. 4.

In this case, means 10' are provided in the said zone 2 in order to secure the two elements 3', 4' opposite to each other.

These securing means 10' are can be spacers and/or rods for example, distributed about the vertical axis (Z) and whose extremities are fixed to elements 3' and 4'.

Zone 2 can also be composed of air and of the single block of material 10.

A non-limiting example is provided in FIG. 5.

Here, the single block of material 10 has two sections (T, T') in contact with the air.

More precisely, it has an external section (T) constituting one external side of the antenna, and an internal section (T') at least partially containing the central region of zone 2.

Thus, seen in horizontal section, the single block 10 corresponds to a ring placed around the vertical axis (Z).

The internal section (T') contains air, but the invention also allows that it can contain another gas, preferably with dielectric properties.

Advantageously the single block 10 constitutes a support for the two separate elements 3', 4'.

But, it is also possible to strengthen the stiffness of the antenna with securing means 10' (not shown in FIG. 5) such as the aforementioned rods or spacers.

As can be seen from the above description, a designer therefore already has considerable flexibility in the design of a UWB antenna to a given set of specifications.

However the antenna according to the invention provides an even greater number of degrees of freedom (parameters).

As mentioned previously, one fundamental parameter of freedom consists of varying the profile (C, C) of the shaped surfaces 3, 4.

According to the invention, in longitudinal section, at least one portion of these profiles (C, C') has a shape that is selected from the following:

a. rectilinear, b. concave in relation to the plane orthogonal to the longitudinal axis (Z) and that contains the horizontal axis (X), c. convex in relation to the plane orthogonal to the longitudinal axis (Z) and that contains the horizontal axis (X).

Thus, each of the two surfaces 3, 4 can consist a juxtaposition of several portions of surface, with these portions having a profile whose shape is different from one to the next.

Naturally it is not excluded that these two shaped surfaces can have a profile that, as a whole, has one of the shapes listed above.

This is also illustrated in a general manner by the appended figures.

For example, FIGS. 1 and 3 showed two shaped surfaces 3, 4 that are symmetrical in relation to the horizontal axis, with a profile (C) that, as a whole, was of convex parabolic shape in relation to this axis.

FIG. 3B differs in particular from FIG. 3A by the fact that the profiles (C) include an inflection point.

In FIG. 6, the surfaces 3, 4 include a profile (C, C) in the form of a parabola that is open upwards and downwards as illustrated in particular in FIG. 1, but with generally different curvatures.

And in contrast to the profile (C) of surface 4, in particular the profile (C') of surface 3 includes an inflection point.

FIG. 7 shows an example of an antenna in which the profile (C') of the shaped surface 3 is flared out to the extent that it becomes horizontal at the distal ends.

As illustrated in these last two figures and in FIG. 8, it can be seen that the designer is also able to play with the fact that symmetry of the profiles (C, C') of the surfaces 4, 3 is not obligatory.

In the examples provided in FIGS. 6 to 8, H and H' refer to the height of the profile (C, C') of the respective surfaces 4, 3.

It is understood that the height in question corresponds to the distance projected on the vertical axis between one distal extremity of the profile and its centre located on the said vertical axis.

In addition, R and R' refer to the radii of the respective surfaces 4, 3. Finally, S refers to the smallest distance that separates the two shaped surfaces 3, 4, or indeed the distance that separates these two surfaces at the centre of zone 2.

In the light of these definitions, the antenna of FIG. 8 is determined by the following system:

$(C')\neq(C)$, $H'>H$, $R'<R$

In the same spirit, the antenna of FIG. 6 is determined by the system:

$(C')\neq(C)$, $H'=H$, $R'=R$ and that of FIG. 7 by:

$(C')\neq(C)$, $H'>H$, $R'>R$

Naturally, there exist other possible systems in which use is made of asymmetry in the profiles of the facing surfaces 3, 4, by varying at least one of parameters H, R and profile C.

Another parameter of freedom offered to the designer consists of varying the profile of the section or sections (T, T') of the single block of material 10.

Like the profile (C, C') of the shaped surfaces 4, 3, a portion at least of the profiles of the section or sections (T, T') has, in longitudinal section, a shape selected from the following:

a. rectilinear, b. concave in relation to the plane orthogonal to the longitudinal axis (Z), and that contains the horizontal axis (X), c. convex in relation to the plane orthogonal to the longitudinal axis (Z), and that contains the horizontal axis (X).

Thus, a section can consist of a juxtaposition of several portions of section, with these portions of section having a profile whose shape is different from one to the next.

Naturally it is not excluded that these two shaped surfaces can have a profile that, as a whole, has one of the shapes from the above list. By way of a non-limiting example, and with reference to FIGS. 3 to 8 in particular, the profile of an external and/or internal section can therefore, as a whole, be rectilinear and inclined or non in relation to the longitudinal axis (FIGS. 3, 5, 6, 7 and 8 for example), curved toward the exterior (FIG. 9), or curved toward the interior (FIG. 10).

Another parameter of freedom offered to the designer is the ability to have at least one conducting pattern 11 on a section of the single block 10 so as to contribute once more to controlling the characteristics of the electromagnetic field in zone 2, namely to controlling the radiation characteristics of the antenna such as, in particular, the appearance of the radiation patterns, the value of the directivity, or the polarisation.

In FIG. 11 for example, several conducting patterns are printed on the external section (T) of the antenna.

Yet another parameter of freedom consists of varying the geometry of the stub 7 by modifying either its shape or its dimensions (d and/or h).

By way of a non-limiting example, the stub can have the shape of a trapezium in longitudinal section, with the smallest side being that at the bottom.

FIG. 12 illustrates an additional advantage of the antenna according to the invention.

In fact, the antenna can be arranged to accept an electronic circuit not far from it 12, and to protect it from the electromagnetic field that it is radiating.

Preferably, the electronic circuit 12 is placed as close as possible to the antenna 1, which also results in optimisation of the signal-to-noise ratio.

As again illustrated in FIG. 12, the circuit is incorporated into a recess 13 on the outside of the antenna.

When the antenna is viewed from below, this recess 13 corresponds in this non-limiting example to the recess formed by the concave shape of the profile (C) of the second shaped surface 4.

We will now present a process for the manufacture of an antenna according to the invention, such as the antenna of FIG. 3.

This process is based firstly on the shaping of the single block of material 10.

It will be noted that the choice of the material also constitutes an additional parameter of freedom for the design of the antenna.

In general, it is proposed to use a dielectric material, preferably of the foam or plastic type, with electrical characteristics such that $\in_r$ is relatively close to 1, and tg(δ) is of the lowest possible value ($\in_r$ is the relative permittivity, and tg(δ) the dielectric loss tangent and preferably less than $10^{-3}$ in the invention).

The shaping of the single block 10 can be effected either by machining or by moulding of the desired part, from an appropriate choice of material.

Having completed the shaping, selective metal coating is performed on all profiled surfaces of the shaped surface 3, on which the matching stub 7 has been created, as well as on the shaped surface 4.

Only a circular resist at the connection with the coaxial line 6 is placed on the shaped surface 4. The said metal coating can be effected, for example, by the deposition of a conducting paint or by the electrochemical deposition of a metal.

In this regard, it will be noted that, for its part, the section (T) of the single block support 10 is not metal coated.

Finally, the coaxial line 6 can then be connected to the antenna.

In this case, electrical continuity, by brazing or by a conducting adhesive, must be provided firstly between the peripheral conductor 6' positioned at the resist and the metal coating on the surface 4, and secondly, between the central conductor of the coaxial cable 6" and the bottom part of the matching stub 7.

As will have been understood from the foregoing, the central core 6" then traverses the single block of dielectric material 10 via a small hole of height e.

This manufacturing process has the advantage of being very easy to implement and a low cost.

Regarding technological reproducibility, having only a single part on which all of the elements making up the antenna are created enables a high degree of control to be exercised over the positioning of these elements, and particularly the spacing and alignment between the two shaped surfaces 3, 4.

We will now present some detailed examples of implementation of the invention, as well as performance results obtained from these examples.

FIG. 13 illustrates a first example of a UWB antenna, which is composed of two spherical caps with a radius of curvature of Rc=32.5 mm, symmetrical in relation to each other and with dimensions H=13 mm and R=26 mm, with a fixed spacing between them of S=3 mm.

Meeting the extreme edges of these two caps, the section (T) presented by the antenna then corresponds to a cylindrical section with radius R=26 mm and height 2H+S=29 mm.

For its part, the matching stub 7 has a cylindrical geometry with a height h=2.5 mm and a diameter of d=3.5 mm.

Concerning the feeder means 6, the retained solution is to use a standard Teflon coaxial cable, with a characteristic impedance of 50Ω.

The single block of dielectric material 10 is polymethacrylate imide foam with the electrical characteristics $\in_r$=1.11 and tg(δ)=$7\cdot10^{-4}$, these being measured at 5 GHz.

In this present case, this material 10 (a single block of foam, for example) has been machined by micro-milling to collectively create the assembly comprising the surfaces 3, 4, and the matching element 7 in a single part.

Regarding the selective metal coating of the conducting zones on the antenna, the latter was effected the material 10 by direct deposition of a silver-based metallic paint.

Concerning the operation of this antenna, a simulation exercise was conducted with the aid of an electromagnetic CAD application, working in the time domain.

Simulation of the reflection coefficient 39, presented in FIG. 14, emphasises that the matching level of this antenna is always less than −10 dB over all of the 3.1 GHz-10.6 GHz frequency band considered here by way of an example, which is satisfactory.

In addition, FIG. 15 gives the radiation patterns in azimuth and in elevation for several frequencies spread over the whole bandwidth (i.e. 3.1 GHz, 5.0 GHz, 6.85 GHz, 8.5 GHz and 10.6 GHz).

In this case, it is observed that the radiation of the antenna is indeed of the omnidirectional type in the azimuthal plane, with a slight dispersion of the value of the gain in this plane as a function of the frequency (0.6 dBi, −2.4 dBi, 1.1 dBi, 2.4 dBi and 1.7 dBi respectively for the previous frequency values).

Following an initial phase of simulation of the antenna performance, several prototypes were created and characterised by matching and by transmission, with the latter measurement being effected in the azimuthal plane and on the basis of a simple link performance between two antennae of the invention, separated by a distance D.

$$Pr = Pe \cdot G^2 \cdot \left(\frac{\lambda}{4\pi D}\right)^2$$

where λ is the wavelength, Pr the received power, G the gain of the antennae, and Pe the transmitted power.

From the general equation for link performance, it is then possible to deduce the experimental value of the gain of the antenna as a function of the frequency, in this azimuthal plane, and to compare it with that obtained from the theory.

The experimental results corresponding, to the matching and the value of the gain, confirm the performance simulated over a working band of 3.1 GHz-10.6 GHz.

Referring in particular to FIG. 16, the matching level 40 remains permanently less than −10 dB over all of the working band.

For the value of the gain in the azimuthal plane as a function of the frequency, the measured curve 41 brings out ripple effects associated with the presence of multiple paths.

These exist for the reason that the characterisation was not conducted in an anechoic chamber.

The result obtained for the gain is therefore more qualitative than quantitative.

Nevertheless, it can be seen that, over the band of interest, namely 3.1 GHz-10.6 GHz, the measured values remain within the range [−2.5 dBi, 2.5 dBi], which is in agreement with the simulations.

A second detailed example of implementation of an antenna according to the invention is illustrated in FIG. 17.

In this case it is a compact UWB antenna whose elements 3, 4 are asymmetrical in relation to the horizontal axis but that have a symmetry of revolution about the longitudinal axis (Z).

FIG. 18 shows a simulation of the reflection coefficient 42 of this antenna as a function of the working frequency.

It can be observed that this coefficient 42 maintains a level of less than −10 dB over the whole band, namely 3.1 GHz-10.6 GHz. In addition, FIG. 19 represents the radiation patterns in azimuth and in elevation at the same frequencies as those retained in the case of the first implementation example (i.e. 3.1 GHz, 5.0 GHz, 6.85 GHz, 8.5 GHz and 10.6 GHz).

It is again observed that the radiation from the antenna is still of the omnidirectional type in azimuth, associated with a slight variation in the value of the gain in this plane, as a function of the frequency (respectively 1.5 dBi, −0.4 dBi, −2.1 dBi, 0.5 dBi and 0.5 dBi for the frequencies mentioned earlier).

From the experimental viewpoint, the measurements effected on this antenna show that it is indeed matched, since the measured level of the reflection coefficient 43 is always less than −15 dB over all of the band 3.1 GHz-10.6 GHz (see FIG. 20).

Regarding the value of the gain 44 in the azimuthal plane as a function of the frequency, the latter is again in agreement with the simulation, with a small variation over the range [−2 dBi, 2 dBi].

Finally, a third example of an antenna is described briefly below and illustrated in FIG. 21.

The shaped surface 4 of this antenna comes in the form of a spherical cap, while the shaped top surface 3 has a profile shaped like an inverted bell flared out at the edges.

Experimental measurements on the matching and the gain in the azimuthal plane are provided in FIG. 22.

It can be seen that the reflection coefficient 50 is always less than −12 dB over the whole working band of 3.1 GHz-10.6 GHz. This antenna is therefore matched quite satisfactorily, as in the case of the previous antennae.

Concerning the gain 51, it can be observed that this varies very little with the frequency, and that its value in fact remains permanently inside the range [−1.5; 1.5 dBi].

As a consequence, this third example of implementation enables one to offer satisfactory performance and in particular a very modest volume.

In fact, the volume of this antenna is just 37.7 $cm^3$, while the volume occupied by the first implementation example described earlier is 61.6 $cm^3$. In the case where one is seeking to reduce still further the volume occupied by the type of antenna chosen in this example, it will be noted that it was possible to create an antenna with a volume of 17.7 $cm^3$, which is a reduction of 70% in relation to the first implementation example, while still achieving satisfactory performance, and in particular a reflection coefficient that is always less than −9 dB in the band considered, and a gain in the azimuthal plane that also displays small variations with the frequency over a range of [−2 dBi, 2 dBi].

It can also be seen that this antenna is advantageously compact. Naturally, the present invention is not limited in any way to the form of implementation described above and represented in the drawings.

In conclusion, the invention proposes an ultra-wideband antenna offering a very high degree of design flexibility and that can be used to satisfy very varied specifications.

Such an antenna can therefore be used both in military and civilian applications (for general or specialist use).

By way of a non-limiting example, one can envisage fitting one or more antennae of the invention in a variety of equipment such as in a computer, a fixed or mobile telephone, a printer, a television set, a CD-ROM drive, or more generally in any equipment where wireless communication is used.

BIBLIOGRAPHIC REFERENCES

[1]: "Short wave antenna"
P. S. Carter
U.S. Pat. No. 2,175,252—Publication date: 10 Oct. 1939
[2]: "Wide band, short wave antenna and transmission line System"
P. S. Carter
U.S. Pat. No. 2,181,870—Publication date: 5 Dec. 1939
[3]: "Dielectrically wedged biconical antenna"
J. W. Clark et al.
U.S. Pat. No. 2,599,896—Publication date: 10 Jun. 1952
[4]: "Asymmetrical biconical horn antenna"
K. W. Duncan et al. (Raytheon)
U.S. Pat. No. 4,947,181—Publication date: 7 Aug. 1990
[5]: "Ultra short wave radio System"
S. A. Schelkunoff
U.S. Pat. No. 2,235,506—Publication date: 18 Mar. 1941
[6]: "Broadband ellipsoidal dipole antenna"
W. Stohr
U.S. Pat. No. 3,364,491—Publication date: 16 Jan. 1968
[7]: "Wide band antenna"
N. E. Lindenblad
U.S. Pat. No. 2,239,724—Publication date: 29 Apr. 1941
[8]: "Broad band antenna"
L. N. Brillouin
U.S. Pat. No. 2,454,766—Publication date: 30 Nov. 1948
[9]: "Horn antenna with wide flare angle"
R J. Dewey (Philips)
U.S. Pat. No. 4,630,062—Publication date: 16 Dec. 1986

[10]: "Ultra-broadband TEM double flared exponential horn antenna"
J. D. Cermignani et al. (Grumman Aerospace Corp.)
U.S. Pat. No. 5,325,105—Publication date: 28 Jun. 1994
[11]: "Broadband notch antenna"
F. Lalezari et al.
U.S. Pat. No. 4,843,403—Publication date: 27 Jun. 1989
[12]: "A broadband omnidirectional antenna"
R. M. Taylor
IEEE APS Int. Symp., June 1994, Vol. (2)2, pp 1294-1297

The invention claimed is:

1. An ultra wideband antenna comprising:

a radiating element comprising a first surface, a second surface, and a zone formed at least in part by the first surface and the second surface, wherein the first surface is positioned opposite of the second surface relative to a plane that is perpendicular to a longitudinal axis of the antenna and that contains a horizontal axis of the antenna, wherein the first surface and the second surface have a symmetry of revolution about the longitudinal axis of the antenna, and wherein the first surface and the second surface have a profile and dimensions configured to provide a substantially constant gain over a predetermined frequency band, and wherein the first surface is at least one of concave and convex and the second surface is at least one of concave and convex;

a feeder that extends into at least a portion of the zone and that is configured to supply a signal to the zone; and a matching element configured to couple the feeder to the zone.

2. The ultra wideband antenna of claim 1, wherein at least a portion of the feeder is parallel to the longitudinal axis of the antenna.

3. The ultra wideband antenna of claim 1, wherein the matching element is mounted to the second surface and extends toward the first surface.

4. The ultra wideband antenna of claim 1, wherein the first surface includes an orifice configured to receive the feeder.

5. The ultra wideband antenna of claim 1, wherein the feeder comprises a coaxial cable having a central core and a peripheral conductor.

6. The ultra wideband antenna of claim 5, wherein the central core is configured to contact the matching element.

7. The ultra wideband antenna of claim 5, wherein the peripheral conductor is configured to contact the first surface.

8. The ultra wideband antenna of claim 7, wherein the first surface includes a coat of conducting material.

9. The ultra wideband antenna of claim 8, wherein the coat of conducting material is applied through at least one of electrochemical deposition or a conducting paint.

10. The ultra wideband antenna of claim 1, wherein at least a portion of the zone is filled with air.

11. The ultra wideband antenna of claim 1, wherein at least a portion of the zone includes a block of material, and wherein the block of material is symmetrical about the longitudinal axis of the antenna.

12. The ultra wideband antenna of claim 11, wherein the block of material is ring-shaped.

13. The ultra wideband antenna of claim 11, wherein the block of material forms a first side and a second side of the antenna.

14. The ultra wideband antenna of claim 11, wherein a cross-section of the block of material relative to the longitudinal axis is rectilinear, concave, or convex.

15. The ultra wideband antenna of claim 11, wherein the block of material forms the first surface and the second surface.

16. The ultra wideband antenna of claim 11, wherein the block of material comprises a dielectric material formed from at least one of foam, plastic, or ceramic.

17. The ultra wideband antenna of claim 16, wherein the dielectric material has a relative permittivity of approximately 1 and a dielectric loss tangent less than $10^{-3}$.

18. The ultra wideband antenna of claim 11, wherein the block of material comprises polymethacrylate imide foam.

19. The ultra wideband antenna of claim 11, wherein the block of material includes a conducting pattern.

20. The ultra wideband antenna of claim 11, wherein matching element is part of the single block of material.

21. The ultra wideband antenna of claim 1, further comprising a rod having a first extremity mounted to the first surface and a second extremity mounted to the second surface.

22. The ultra wideband antenna of claim 1, wherein the first surface includes an inflection point.

23. The ultra wideband antenna of claim 1, further comprising an electronic circuit.

24. The ultra wideband antenna of claim 23, wherein the electronic circuit is incorporated into a recess in at least one of the first surface or the second surface such that the electronic circuit is protected from an electromagnetic field generated by the antenna.

25. The ultra wideband antenna of claim 1, wherein variation of the substantially constant gain is less than 1.5 decibels over the predetermined frequency band.

26. The ultra wideband antenna of claim 25, wherein the predetermined frequency band has a maximum frequency and a minimum frequency, and wherein a quotient of the maximum frequency divided by the minimum frequency is five.

27. The ultra wideband antenna of claim 1, wherein the matching element comprises at least one of a cylindrical stub or a trapezium.

28. The ultra wideband antenna of claim 1, wherein an edge of the first surface is flared such that the edge is substantially parallel to the horizontal axis.

29. The ultra wideband antenna of claim 1, wherein a shortest distance between the first surface and the second surface is at a center of the first surface.

30. The ultra wideband antenna of claim 1, wherein the first surface and the second surface are symmetrical about the horizontal axis.

31. A method for forming an ultra wideband antenna comprising:

forming a radiating element comprising a first surface, a second surface, and a zone formed at least in part by the first surface and the second surface, wherein the first surface is positioned opposite of the second surface relative to a plane that is perpendicular to a longitudinal axis of the antenna and that contains a horizontal axis of the antenna, wherein the first surface and the second surface have a symmetry of revolution about the longitudinal axis of the antenna, and wherein the first surface and the second surface have a profile and dimensions configured to provide a substantially constant gain over a predetermined frequency band, and wherein the first surface is at least one of concave and convex and the second surface is at least one of concave and convex;

mounting a feeder to the first surface such the feeder extends into at least a portion of the zone, wherein the feeder is configured to supply a signal to the zone; and mounting a matching element to the second surface, wherein the matching element is configured to couple the feeder to the zone.

32. The method of claim 31, further comprising incorporating an electronic circuit into a recess in at least one of the first surface or the second surface such that the electronic circuit is protected from an electromagnetic field generated by the antenna.

33. The method of claim 31, further comprising mounting a rod between the first surface and the second surface.

34. The method of claim 31, further comprising mounting a dielectric material in at least a portion of the zone.

35. The method of claim 34, wherein the dielectric material forms a first side and a second side of the antenna.

36. The method of claim 31, further comprising applying a coat of conducting material to the first surface.

37. An ultra wideband antenna comprising:

a radiating element comprising a first surface, a second surface, and a zone formed at least in part by the first surface and the second surface, wherein the first surface is positioned opposite of the second surface relative to a plane that is perpendicular to a longitudinal axis of the antenna and that contains a horizontal axis of the antenna, wherein the first surface and the second surface have a symmetry of revolution about the longitudinal axis of the antenna, and wherein the first surface and the second surface have a profile and dimensions configured to provide a substantially constant gain over a predetermined frequency band, and wherein the first surface is at least one of concave and convex and the second surface is at least one of concave and convex;

means for supplying a signal to the zone; and means for coupling the signal to the zone.

38. The ultra wideband antenna of claim 37, wherein the first surface includes an orifice configured to receive the means for supplying the signal.

39. The ultra wideband antenna of claim 37, further comprising means for maintaining a fixed distance between the first surface and the second surface.

40. The ultra wideband antenna of claim 37, wherein variation of the substantially constant gain is less than 1.5 decibels over the predetermined frequency band.

* * * * *

UNITED STATES PATENT AND TRADEMARK OFFICE

CERTIFICATE OF CORRECTION

PATENT NO. : 8,013,801 B2
APPLICATION NO. : 11/887020
DATED : September 6, 2011
INVENTOR(S) : Coupez et al.

It is certified that error appears in the above-identified patent and that said Letters Patent is hereby corrected as shown below:

Column 14, line 62, in Claim 31, delete “such the” and insert -- such that the --.

Signed and Sealed this
Thirteenth Day of March, 2012

David J. Kappos

David J. Kappos
*Director of the United States Patent and Trademark Office*